US006025103A

United States Patent [19]

Nakamura et al.

[11] Patent Number: 6,025,103

[45] **Date of Patent: *Feb. 15, 2000**

[54] HIGHLY PURE MATERIAL FOR ELECTROPHOTOGRAPHIC PRINTING, AND METHOD OF MANUFACTURING SUCH HIGHLY PURE MATERIAL

[75] Inventors: Yasushige Nakamura; Norio Sawatari, both of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/967,238

[22] Filed: Nov. 5, 1997

Related U.S. Application Data

[63] Continuation of application No. 08/673,322, Jun. 28, 1996, abandoned, which is a continuation-in-part of application No. 08/409,955, Mar. 23, 1995, abandoned, which is a continuation of application No. 08/045,727, Apr. 14, 1993, abandoned.

[30] Foreign Application Priority Data

Apr. 24, 1992 [JP] Japan ..... 4-106491

[51] Int. Cl.[7] ..... G03G 9/113

[52] U.S. Cl. ..... 430/106.6; 430/108; 430/137

[58] Field of Search ..... 430/106.6, 108, 430/137

[56] References Cited

U.S. PATENT DOCUMENTS 4,912,009 3/1990 Amering et al. ..... 430/137
5,162,187 11/1992 Lyons et al. ..... 430/106.6

FOREIGN PATENT DOCUMENTS 7-146592 6/1995 Japan .

OTHER PUBLICATIONS

*Physical Chemistry, Second Edition*, J.Philip Bromberg, pp. 304–311 (1984).
Diamond, Arthur S. (1991) *Handbook of Imaging Materials*. New York: Marcel–Dekker Inc., pp. 213–215.
*CRC Handbook of Chemistry and Physics*, 66th Edition, RC Weast, editor, CRC Press, Inc.,, Boca Raton, FL, pp. D–165 —D–167 (1985).
English Translation of JP 7–146592 Jun. 1995.

*Primary Examiner*—Christopher D. Rodee
*Attorney, Agent, or Firm*—Staas & Halsey LLP

[57] ABSTRACT

Toner magnetic powder which uses a resin as a binder and contains a dye is coated by a methyl methacrylate resin, thereby forming a carrier. A developer is formed by such a carrier in which those two components are mixed. An electric conductivity of the impurity extracted water of the carrier due to the pressurization in the pure water is set to 60 $\mu$S/cm or less. Namely, the purity is improved so that the electric conductivity of the impurity extracted water of the methyl methacrylate resin due to the pressurization in the pure water is set to 20 $\mu$S/cm or less, and the purity is improved so that the electric conductivity of the impurity extracted water of the magnetic powder due to the pressurization in the pure water is set to 60 $\mu$S/cm or less, thereby forming a carrier. A carbon addition amount upon manufacturing of the carrier is controlled so that the electric resistance of the carrier is set to a value within a range of $1\times10^4$ to $1\times10^8$ Ωcm. Further, a carbon addition amount upon manufacturing of the toner is limited so that the electric resisance of the toner is set to $1\times10^{11}$ Ωcm or more.

4 Claims, 1 Drawing Sheet

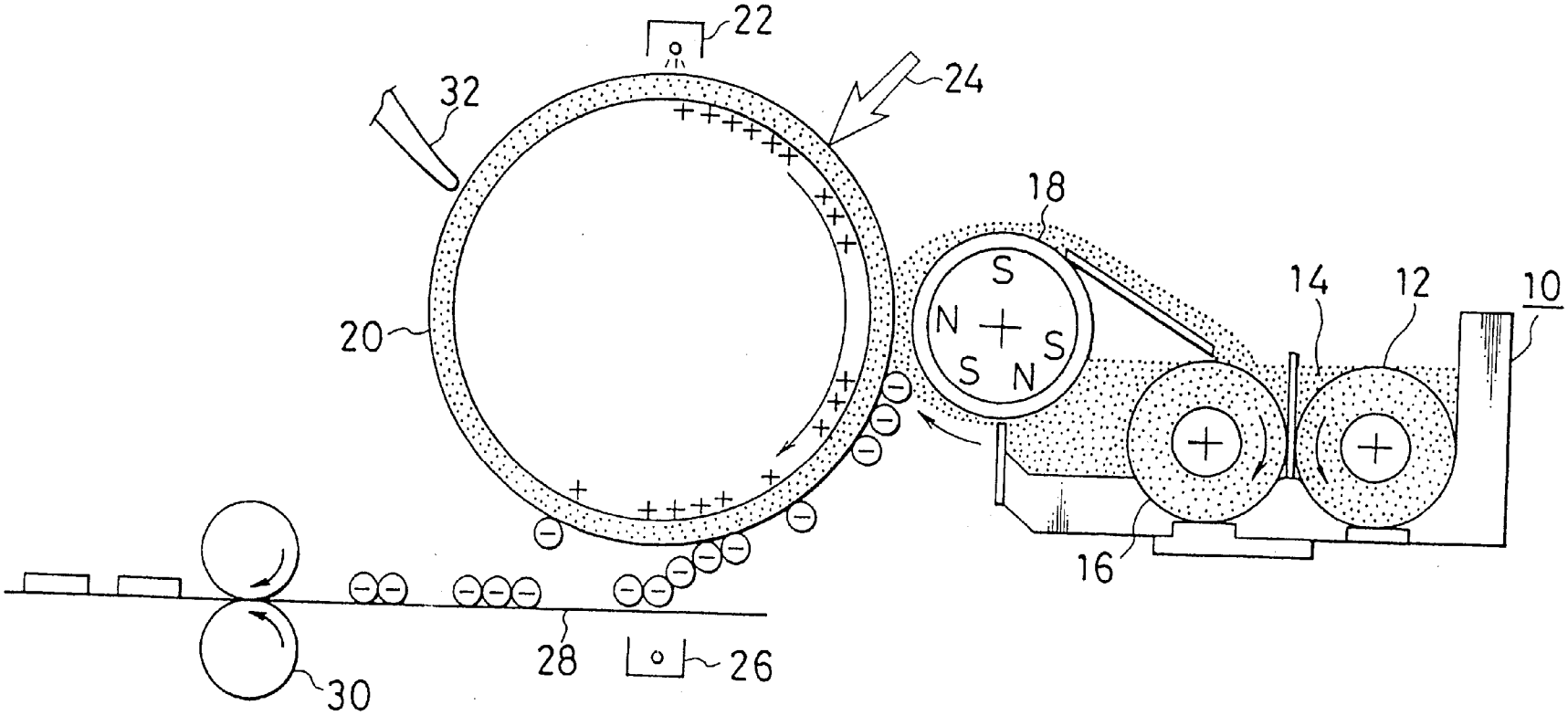
10
12
14
16
18
S
N
S
S
N
24
22
26
28
32
20
30

HIGHLY PURE MATERIAL FOR ELECTROPHOTOGRAPHIC PRINTING, AND METHOD OF MANUFACTURING SUCH HIGHLY PURE MATERIAL

This application is a continuation of application Ser. No. 08/673,322, filed Jun. 28, 1996, now abandoned, which was a continuation-in-part application of application Ser. No. 08/409,955, filed Mar. 23, 1995, now abandoned, which was a continuation of application Ser. No. 08/045,727, filed Apr. 14, 1993, now abandoned.

BACKGROUND OF THE INVENTION

The present invention relates to a developer which is used to develop an electrostatic latent image in an electrophotographying method or the like and, more particularly, to a developer in which two components of the toner and carrier are mixed.

Hitherto, as an electrophotographying method, a method disclosed in U.S. Pat. No. 2,297,691 or the like has been known. According to the above electrophotographying method, in general, a photoconductive insulating material (photocon drum or the like) is used, uniform electrostatic charges are given onto the photoconductive insulating material by a corona discharge or the like and a light image is irradiated onto the photoconductive insulating material by various kinds of means, thereby forming an electrostatic latent image. Subsequently, by developing the latent image by using fine powder called a toner, its visual image is derived. The toner image is copy transferred onto a paper or the like as necessary. The toner image is fused by using a pressurizing method, a heating method, a solvent vapor, a light, or the like and is fixed onto the paper or the like, thereby obtaining a printed matter.

As toner to develop the electrostatic latent images, hitherto, a colorant or the like such as carbon black or the like is dispersed into a binder resin made of a natural or synthetic high polymer material and the resultant resin is finely ground so as to have diameters of about 1 to 30 $\mu$m and the resultant particles are used as such a toner. The toner is ordinarily mixed to the carrier such as iron powder, glass beads, or the like and is used to develop the electrostatic latent image. In case of using the iron powder or other ferromagnetic particles as carrier, the developer consisting of the toner and carrier is mixed and stirred in a developing apparatus, so that it is frictionally charged. The charged carrier is further held by a magnet roll in the developing apparatus and forms a magnetic brush. By rotating the magnet roll, the magnetic brush is carried to the latent image portion on the photoconductive insulating material. Only the charged toner is deposited to the latent image by an electrical attracting force, thereby performing the development.

In such a conventional developer, however, when it is used in an environment in a range from a low temperature of 10° C. and a low humidity of 20% RH (RH: an abbreviation of relative humidity) to a high temperature of 30° C. and a high humidity of 80% RH, a friction charging property of the developer changes to a state of an ordinary temperature and an ordinary humidity, so that there is a case where such that print blur, print blank, or background fog occurs. To solve such a problem, devises have conventionally been made with respect to the developers. For instance, in an environment of a low temperature and a low humidity, a charging amount of the developer increases, so that there is a case where a print density decreases, a print blur occurs, or a print blank due to the deposition of the carrier onto the photo sensitive drum occurs. Since the charging amount of the developer decreases in the high-temperature and high-humidity environment, a fog such that an unnecessary image is generated in the background portion of the paper occurs. There is also a case where a resistance of carrier decreases because of the deposition of the moisture of the developer, the inverse charging toner is generated due to the injection of charges into the toner from a developing roller and appears as a fog in the background portion of the photo sensitive drum although no background fog occurs on the paper, so that the toner is consumed in vain.

On the other hand, hitherto, a fluctuation of charging amount in a low-temperature and low-humidity environment or a high-temperature and high-humidity environment has been solved by using the carrier such that the magnetic powder is coated by a resin of the fluorine system or silicon system of a high hydrophobic property. To prevent the generation of the inverse charging toner due to a decrease in electric resistance in a high-temperature and high-humidity environment, the carrier of a high resistance of $10^{10}$ Ωcm or higher is used, thereby preventing the injection of the charges from the developing roller.

In recent years, however, the realization of a low end of the printer and its personalization have rapidly been being progressed. The use environment is further extended to a wide range. As a printer, stable printing characteristics in a range from an environment of a superlow temperature of 0° C. and a low humidity of 0% RH to an environment of a superhigh temperature of 40° C. and a high humidity of 80% RH are demanded. In the conventional developer, on the other hand, a charging amount of the developer certainly rises in the low-temperature and a low-humidity environment, so that a print blur or carrier deposition occurs. On the other hand, there is also a case where in the high-temperature and high humidity environment, a background fog occurs on the paper due to a decrease in charging amount. Namely, to assure a print density in the superlow-temperature and low-humidity environment of 0° C. and 0% RH, it is inevitable to avoid a resistance value of the carrier.

It has been found out that the print blur or carrier deposition in the superlow-temperature and low-humidity environment of 0° C. and 0% RH are solved by setting the electric resistance of the carrier to $1\times10^{8}$ Ωcm or less. However, when the resistance of carrier is reduced, on the contrary, a resistance value decreases due to a blur of the paper or the deposition of the moisture of the carrier because of the reduction of the charging amount of the developer in the environment of a superhigh temperature of 40° C. and a high humidity of 80% RH, so that a background fog of the photo sensitive drum occurs and deteriorates.

Such a decrease in charging amount of the developer and a decrease in electric resistance of the carrier due to the moisture deposition are not solved even by using the conventional carrier obtained by coating the resin of the fluorine system or silicon system of a high hydrophobic property to the magnetic powder. Namely, there is a limitation when those methods are used. In case of using the coating carrier of the silicon resin system of a high hydrophobic property, as compared with the carrier which is not coated, an image is preferably seen even for a fog until a high-temperature and a high humidity environment of about 30° C. and 80% RH. It has been found out, however, that there is hardly an effect in the environment of a high temperature of 40° C. and a high humidity of 80% RH and a fog occurs on the whole region of the background of each of the paper and the photo sensitive drum.

It is an object of the present invention to provide a developer which is used in the electrophotographying method and which can solve the occurrence of a fog even in a use environment in a range from a superlow temperature and a low humidity and a superhigh temperature and a high humidity and also to provide a method of manufacturing such a developer. More particularly, another object of the invention is to provide a carrier as an intermediate material and its manufacturing method.

SUMMARY OF THE INVENTION

We have vigorously studied the development which is obtained by mixing two components comprising a toner which uses a resin as a binder and contains a dye and a carrier such that the surfaces of magnetic powder are coated by a methyl methacrylate resin. It has consequently been found out that the above object is accomplished by improving a purity of the magnetic powder serving as a core of the carrier and a purity of the coating resin.

That is, we have tried to solve the following problems (1) and (2) in the environment of a superhigh temperature of 40° C. and a high humidity of 80% RH while keeping a high print density in the environment of a superlow temperature of 0° C. and a low humidity of 0% RH by using the carrier of a low resistance value within a range from $10^4$ to $10^8$ Ωcm.

(1) Background fog on the paper due to the low charging toner (2) Background fog on the photo sensitive drum which is not copy transferred onto the paper and which occurs because the toner exhibits an inverse charging property due to a low resistance of the carrier.

The background fog on the paper due to the low charging toner depends on a remaining amount of a stabilizer which occurs when a polymethyl methacrylate resin that is used upon coating of the magnetic powder is manufactured by suspension or emulsion polymerization. It has been found that the coating layer of the carrier absorbs the moisture by the stabilizer and the charging amount of the developer decreases. That is, it has been found out that a factor to reduce the charging property of the developer in the environment of a superhigh temperature of 40° C. and a high humidity of 80% RH doesn't depend on the nature of the polymethyl methacrylate resin itself which is used to coat the magnetic powder but is based on an amount of dodecyl benzene sodium sulfonate as a stabilizer which has been added upon manufacturing of the polymethyl methacrylate resin and remains without being cleaned. That is, to prevent the reduction of the charging, it is necessary to increase the number of cleaning times of the polymethyl methacrylate resin which has been manufactured by suspension or emulsion polymerization and to thereby reduce the remaining amount of dodecyl benzene sodium sulfonate.

As a reference value of the remaining amount of dodecyl benzene sodium sulfonate, there are used an electric conductivity of the extracted water due to the pressurization in the pure water to the polymethyl methacrylate resin manufactured and the measurement values which are obtained by a method whereby $Na^+$ and $SO_4^{2-}$ as ionic impurities of the stabilizer contained are measured by the ion chromatography of its extracted water.

To eliminate the background fog on the paper by the low charging toner of the above item (1) in the environment of a superhigh temperature of 40° C. and a high humidity of 80% RH, it is necessary that an electric conductivity of the extracted water of the polymethyl methacrylate resin is set to be 20 μS/cm or less (when measured at 25° C.) and that impurities of $Na^+$ and $SO_4^{2-}$ in this instance are set to be 1 ppm or less and 4 ppm or less for polymethyl methacrylate, respectively. All extracted water conductivities referred to hereinafter are determined at 25° C. Dodecyl benzene sodium sulfonate contained in the polymethyl methacrylate resin is eliminated by a method whereby it is cleaned by using the pure water in the pressurized and heated environment of a pressure of 4 atm, a temperature of 143° C., and a humidity of 100% RH, while an electric conductivity of the extracted water of the polymethyl methacrylate resin is set to 20 μS/cm or less. Consequently, even in the environment of a superhigh temperature of 40° C. and a high humidity of 80% RH, a charging amount of the developer is suppressed to 60% or more of that at an ordinary temperature (25° C.) and an ordinary humidity (40% RH) and the background fog on the paper due to the low charging toner doesn't occur.

However, even when the purities are improved by eliminating the stabilizer from the polymethyl methacrylate, the background fog on the photo sensitive drum of the above item (2) is not still solved. We have, therefore, tried to mainly reduce a concentration of impurity contained in the magnetic powder serving as a core of the carrier. Mn—Zn ferrite or magnetite is used as a magnetic powder, the pure water is used to clean the magnetic powder, and the magnetic powder is further cleaned by pressurizing and heating in the environment of a pressure of 4 atm, a temperature of 143° C., and a humidity of 100% RH. By executing the cleaning process so as to set the electric conductivity of the extracted water of the impurity of the carrier powder to 60 μS/cm or less and to reduce a concentration of $Na^+$ as impurity to 15 ppm or less, the generation of the inverse charging toner as a cause of the background fog of the photo sensitive drum is suppressed. Although its reason is not clearly understood yet, probably, it is considered that when a thin portion of the coating resin exists on the magnetic powder and ionic impurities exist in the magnetic powder, the moisture is deposited through the portion of the coating resin in the environment of a superhigh temperature of 40° C. and a high humidity of 80% RH and the resistance value of the carrier decreases, thereby causing a background fog on the photo sensitive drum.

Therefore, the methyl methacrylate resin whose purity has been improved so that the electric conductivity of the impurity extracted water due to the pressurization in the pure water is set to 20 μS/cm or less is used, the magnetic powder whose purity has been improved so that the electric conductivity of the impurity extracted water by the pressurization in the pure water is set to 60 μS/cm or less is coated to thereby manufacture the carrier, and the developer in which the carrier and the toner are mixed is formed. With such a developer, the background fog on the paper of the above item (1) and the background fog on the photo sensitive drum of the item (2) can be eliminated.

With respect to the carrier manufactured while improving the purities of the methyl methacrylate and magnetic powder, the electric conductivity of the impurity extracted water by the pressurization in the pure water is measured. When such an electric conductivity is equal to or less than 60 μS/cm, the background fog on the paper of the item (1) and the background fog on the photo sensitive drum of the item (2) can be solved. It has, consequently, been found out that the stable printing characteristics can be obtained in a range of the environment from the superlow temperature of 0° C. and a low humidity of 0% RH to a superhigh temperature of 40° C. a high humidity of 80% RH.

However, when the resistance of carrier is equal to or less than $10^3$ Ωcm, the background fog on the photo sensitive drum in the environment of a superhigh temperature and a high humidity cannot be eliminated. When the carrier resistance is equal to or larger than $10^9$ Ωcm, a blur occurs due to the continuous printing operations in the environment of a superlow temperature and a low humidity. Therefore, with respect to the carrier, when a coating liquid is formed by dissolving the methyl methacrylate resin of 90 weight % whose purity has been improved into methyl ethyl ketone of 1000 weight %, the addition amount of the carbon black is adjusted by one weight % as a center, thereby controlling the electric resistance to a value within a range from $10^4$ to $10^8$ Ωcm.

Further, to widen the background fog margin on the photo sensitive drum of the item (2) from the toner side as well, the addition amount of the carbon upon manufacturing of the toner is limited to 4 weight % or less and the electric resistance is set to a high resistance value of $1\times10^{11}$ Ωcm or more.

The measurement of the electric conductivity used as a reference of the ionic impurity concentration of the extracted water was performed in the following manner.

The ionic impurities were extracted by the following method. Namely, the magnetic powder (Mn—Zn ferrite or magnetite) and the polymethyl methacrylate resin as a coating material, or the carrier of 8 g such that the magnetic powder has been coated by the polymethyl methacrylate resin is put into a Pyrex glass beaker containing the pure water of 80 ml and is held for 24 hours by using a pressurizer (pressure cooker tester, TPC-410, Tabiespeck) in the environment of 4 atm, 143° C., and 100% RH. The electric conductivity of the extracted water obtained form the pressurizer is measured at 25° C. by using an electric conductivity measuring instrument (MODEL SI-51: manufactured by Yokogawa Hokushin Co., Ltd.). The detection of the ions due to the electric conductivity of the extracted water and the measurement of the concentration are executed by measuring the extracted water by using the ion chromatography (ion chromato analyzer, MODEL IC-100: by Yokogawa Hokusin Co., Ltd.).

The above and other objects, features, and advantages of the present invention will become more apparent form the following detailed description and the appended claims with reference to the accompanying drawings.

BRIEF DESCRIPTION OF THE DRAWING

The FIGURE is an explanatory diagram of an improved machine of F-6174 used in the evaluation of a developer according to the present invention.

DETAILED DESCRIPTION OF THE PREFERRED EMBODIMENT

The present invention will be described hereinbelow with respect to a preferred embodiment. The present invention, however, is not limited to the embodiment.

The manufacturing of the toner will be first explained.

Toner A

A cross-linking type polyester resin (NE2155: manufactured by Kao Corporation) of 90 weight % as a binder resin, carbon black (BLACK PEARLS L: mean diameter of 2.4 μm, specific surface of 138 $m^2$/g: made by Cabot Co., Ltd.) of 3 weight %, azo-chrome dye (S-34: made by Orient Chemical Co., Ltd.) of 1 weight %, and propylene wax (550-P: Sanyo Chemical Industries, Co., Ltd.) of 4 weight % are added and are melted and kneaded at 160° C. for 30 minutes by a pressurizing kneader, so that a toner block is obtained. The cooled toner block is ground by a rotoplex grinder, thereby obtaining a coarse toner of a diameter of about up to 2 mm. Subsequently, the coarse toner is finely ground by using a jet mill (PJM grinder: made by Nippon Pneumatic Mfg. Co., Ltd.). The ground substances are classified by using an air classifying machine (made by Asupine Co., Ltd.), so that a negative charging toner A of a mean diameter of 10 μm is obtained. A resistance value is equal to $5\times10^{11}$ Ωcm.

Toner B

A carbon addition amount is set to 6 weight % and a toner B is obtained by a method similar to the toner A. A resistance value is equal to $1\times10^{10}$ Ωcm.

The magnetic powder will now be described.

Mn—Zn ferrite (1)

Mn—Zn ferrite of a mean diameter of 60 μm is cleaned by using the pure water for about one hour in the environment of 4 atm, 143° C., and 100% RH, thereby obtaining Mn—Zn ferrite in which the electric conductivity of the extracted water is equal to 40 μS/cm and a concentration of $Na^+$ is equal to 3.3 ppm.

Mn—Zn ferrite (2)

Mn—Zn ferrite of a mean diameter of 60 μm is cleaned by using the service water for about one hour in the environment of 4 atm, 143° C., and 100% RH, thereby obtaining Mn—Zn ferrite in which an electric conductivity of the extracted water is equal to 155 μS/cm and a concentration of $Na^+$ is equal to 55 ppm.

Magnetite (1)

Magnetite of a means diameter of 60 μm is cleaned by using the pure water for about one hour in the environment of 4 atm, 143° C., and 100% RH, thereby obtaining magnetite in which an electric conductivity of the extracted water is equal to 55 μS/cm and a concentration of $Na^+$ is equal to 10 ppm.

Magnetite (2)

Magnetite of a mean diameter of 60 μm is cleaned by using the service water for about one hour in the environment of 4 atm, 143° C., and 100% RH, thereby obtaining magnetite in which an electric conductivity o the extracted water is equal to 165 μS/cm and a concentration of $Na^+$ is equal to 55 ppm.

The coating material will now be described.

Coating material α

A methyl methacrylate resin of 99 weight % and dodecyl benzene sodium sulfonate of 1 weight % serving as a stabilizer are suspended or emulsion polymerized. The polymethyl methacrylate resin manufactured by the suspension or emulsion polymerization is cleaned by using the pure water in the environment of 4 atm, 143° C., and 100% RH. The cleaning in the pressurized and heated environment is continued until an impurity amount of the water after completion of the cleaning operation is equal to an impurity amount before the cleaning operation using the water. By the above cleaning, a polymethyl methacrylate resin of an average molecular amount of 280 thousand is obtained. An electric conductivity of the extracted water of the above resin is equal to 16 μS/cm, a concentration of $Na^+$, and a concentration of $SO_4^{2-}$ is equal to 2.8 ppm.

Coating material β

A methyl methacrylate resin of 99 weight % and dodecyl benzene sodium sulfonate of 1 weight % serving as a stabilizer are suspended or emulsion polymerized. The polymethyl methacrylate resin manufactured by the suspension or emulsion polymerization is cleaned three times by using the water, so that a polymethyl methacrylate resin of an average molecular amount is equal to 280 thousand is obtained. An electric conductivity of the extracted water of the above resin is equal to 40 $\mu$S/cm, a concentration of $Na^+$ is equal to 1.5 ppm, and a concentration of $SO_4^{2-}$ is equal to 4.9 ppm.

Embodiment 1

Mn—Zn ferrite (1) and the coating material α are used and the carrier is manufactured by using a universal stirrer. That is, the coating material α of 90 weight % and carbon black (EC600JD: made by Ketjen Black International Co.) of 10 weight % are dissolved into methyl ethyl ketone of 1000 weight % and are previously stirred, thereby obtaining a coating liquid. The coating liquid of 1 weight % is coated to Mn—Zn ferrite (1) of a mean diameter of 60 $\mu$m of 99 weight % by using a universal stirrer (ACM-5: Aicho Chemical Mixer) at 100° C. while degassing, thereby obtaining a carrier. A resistance value of the carrier is equal to $1\times10^6$ Ωcm and an electric conductivity of the impurity extracted water due to the pressurization in the pure water is equal to 45 $\mu$S/cm.

The carrier of 95 weight % and the toner A of 5 weight % are mixed, thereby forming a developer. As for the developer, a print concentration and a background fog in a range from the environment of a superlow temperature and a low humidity (0° C., 0% RH) to the environment of a superhigh temperature and a high humidity (40° C., 80% RH) are examined by using a remodeled machine F-6174 (made by Fujitsu Ltd.). Thus, by using the above developer, the print blur in the environment of a superlow temperature and a low humidity (0° C., 0% RH) and the fogs of the items (1) and (2) in the environment of a superhigh temperature and a high humidity (40° C., 80% RH) don't occur.

The F-6174 remodeled machine (made by Fujitsu Ltd.) has a structure shown in The FIGURE. A developer 14 put in a tray 10 is stirred by a stirring screw 12 and charged. The charged developer 14 is sent to a developing roller 18 by a feed screw 16. Charges are first uniformly charged on the surface of a photo sensitive drum 20 by a pre-charging unit 22. The drum surface is subsequently exposed (24) by a modulated light of a laser beam or the like. The charges in the light irradiated portion pass through a photoconductive film and escape. The charged developer 14 is supplied to the drum surface by the developing roller 18. The developer 14 is deposited to the portion having no charge to which the light has been irradiated. Subsequently, the developer is copy transferred onto a paper 28 by a copy transfer section 26,←thereby heating and fixing the developer by a fixing section 30. The developer remaining on the drum surface is eliminated by a cleaning section 32.

Embodiment 2

Mn—Zn ferrite (1) and the coating agent α are used and a carrier is manufactured by using the universal stirrer in a manner similar to the embodiment 1. A resistance of the carrier is set to $1\times10^7$ Ωcm by adjusting an amount of carbon black which is put into a coating liquid. An electric conductivity of the impurity extracted water by the pressurization in the pure water is equal to 46 $\mu$S/cm. The carrier of 95 weight % and the toner A of 5 weight % are mixed, thereby forming a developer. As for the developer, a print concentration and a background fog in a range from the environment of a superlow temperature and a low humidity (0° C., 0% RH) to the environment of a superhigh temperature and a high humidity (40° C., 80% RH) are examined by using the F-6174 remodeled machine (made by Fujitsu Ltd.). By using the above developer, thus, the print blur in the environment of a superlow temperature and a low humidity (0° C., 0% RH) and the fogs in the items (1) and (2) in the environment of the superhigh temperature and a high humidity (40° C., 80% RH) don't occur.

Embodiment 3

Mn—Zn ferrite (1) and the coating material α are used and a carrier is formed by using the universal stirrer in a manner similar to the embodiment 1. A resistance of the carrier is set to $1\times10^8$ Ωcm by adjusting an amount of carbon black which is put into the coating liquid. An electric conductivity of the impurity extracted water by the pressurization in the pure water is equal to 43 $\mu$S/cm. The carrier of 95 weight % and the toner A of 5 weight % are mixed, thereby forming a developer. As for the developer, a print density and a background fog in a range from the environment of a superlow temperature and a low humidity (0° C., 0% RH) to the environment of a superhigh temperature and a high humidity (40° C., 80% RH) are examined by using the F-6174 remodeled machine (made by Fujitsu Ltd.) in The FIGURE. Thus, by using the developer, the print blur in the environment of a superlow temperature and a low humidity (0° C., 0% RH) and the fogs of the items (1) and (2) in the environment of a superhigh temperature and a high humidity (40° C., 80% RH) don't occur.

Comparison Example 1

Mn—Zn ferrite (1) and the coating material α are used and a carrier is formed by using the universal stirrer in a manner similar to the embodiment 1. A resistance of the carrier is set to $1\times10^9$ Ωcm by adjusting an amount of carbon black which is put into the coating liquid. An electric conductivity of the impurity extracted water by the pressurization in the pure water is equal to 43 $\mu$S/cm. The carrier of 95 weight % and the toner A of 5 weight % are mixed, thereby forming a developer. With respect to the developer, a print density and a background fog in a range from the environment of a superlow temperature and a low humidity (0° C., 0% RH) to the environment of a superhigh temperature and a high humidity (40° C., 80% RH) are examined by using the F-6174 remodeled machine (made by Fujitsu Ltd.) of The FIGURE. By using the developer, consequently, the fogs of the items (1) and (2) in the environment of a superhigh temperature and a high humidity (40° C., 80% RH) don't occur but a print blur occurs in the environment of a superlow temperature and a low humidity (0° C., 0% RH).

Comparison Example 2

Mn—Zn ferrite (1) and the coating material α are used and a carrier is formed by using the universal stirrer in a manner similar to the embodiment 1. A resistance of the carrier is set to $1\times10^3$ Ωcm by adjusting an amount of carbon black which is put into the coating liquid. An electric conductivity of the impurity extracted water by the pressurization in the pure water is equal to 45 $\mu$S/cm. The carrier of 95 weight % and the toner A of 5 weight % are mixed, thereby forming a developer. With respect to the developer, a print density and a background fog in a range from the environment of a superlow temperature and a low humidity (0° C., 0% RH) to the environment of a superhigh temperature and a high humidity (40° C., 80% RH) are examined by using the F-6174 remodeled machine (made by Fujitsu Ltd.) of The FIGURE. Thus, a blur of the item (2) in the environment of a superhigh temperature and a high humidity (40° C., 80% RH) occurs.

Comparison Example 3

The Mn—Zn ferrite (1) and the coating material α are used and a carrier is formed by using the universal stirrer in a manner similar to the embodiment 1. A resistance of the carrier is set to $1\times10^6$ Ωcm by adjusting an amount of carbon black which is put into the coating liquid. An electric conductivity of the impurity extracted water by the pressurization in the pure water is equal to 45 μS/cm. The carrier and the toner B are used, thereby forming a developer. With respect to the developer, a print density and a background fog in a range from the environment of a superlow temperature and a low humidity (0° C., 0% RH) to the environment of a superhigh temperature and a high humidity (40° C., 80% RH) are examined by using the F-6174 remodeled machine (made by Fujitsu Ltd.) of The FIGURE. By using the developer, consequently, a fog of the item (2) in the environment of a superhigh temperature and a high humidity (40° C., 80% RH) occurs by a little amount.

Comparison Example 4

Mn—Zn ferrite (2) and the coating material α are used and a carrier is formed by using the universal stirrer in a manner similar to the embodiment 1. A resistance of the carrier is set to $1\times10^6$ Ωcm by adjusting an amount of carbon black which is put into the coating liquid. An electric conductivity of the impurity extracted water by the pressurization in the pure water is equal to 120 μS/cm. The carrier of 95 weight % and the toner B of 5 weight % are mixed, thereby forming a developer. With respect to the developer, a print density and a background fog in a range from the environment of a superlow temperature and a low humidity (0° C., 0% RH) to the environment of a superhigh temperature and a high humidity (40° C., 80% RH) are examined by using the F-6174 remodeled machine (made by Fujitsu Ltd.) of The FIGURE. By using the developer, consequently, a fog of the item (2) in the environment of a superhigh temperature and a high humidity (40° C., 80% RH) occurs.

Comparison Example 5

Mn—Zn ferrite (1) and the coating material β are used and a carrier is formed by using the universal stirrer in a manner similar to the embodiment 1. A resistance of the carrier is set to $1\times10^6$ Ωcm by adjusting an amount of carbon black which is put into the coating liquid. An electric conductivity of the impurity extracted water by the pressurization in the pure water is equal to 75 μS/cm. The carrier of 95 weight % and the toner A of 5 weight % are mixed, thereby forming a developer. With respect to the developer, a print density and a background fog in a range from the environment of a superlow temperature and a low humidity (0° C., 0% RH) to the environment of a superhigh and a high humidity (40° C., 80% RH) are examined by using the F-6174 remodeled machine (made by Fujitsu Ltd.) of The FIGURE. By using the developer, consequently, a fog of the item (1) in the environment of a superhigh and a high humidity (40° C., 80% RH) occurs.

Embodiment 4

Magnetite (1) and the coating material α are used and a carrier is formed by using the universal stirrer in a manner similar to the embodiment 1. A resistance of the carrier is set to $1\times10^6$ Ωcm by adjusting an amount of carbon black which is put into the coating liquid. An electric conductivity of the impurity extracted water due to the pressurization in the pure water is equal to 45 μS/cm. The carrier of 95 weight % and the toner A of 5 weight % are mixed, thereby forming a developer. With respect to the developer, a print density and a background fog in a range from the environment of a superlow temperature and a low humidity (0° C., 0% RH) and the environment of a superhigh temperature and a high humidity (40° C., 80% RH) are examined by using the F-6174 remodeled machine (made by Fujitsu Ltd.) of The FIGURE. By using the developer, consequently, a print blur in the environment of a superlow temperature and a low humidity (0° C., 0% RH) and fogs of the items (1) and (2) in the environment of a superhigh temperature and a high humidity (40° C., 80% RH) don't occur.

Comparison Example 6

Magnetite (2) and the coating material α are used and a carrier is formed by using the universal stirrer in a manner similar to the embodiment 1. A resistance of the carrier is set to $1\times10^6$ Ωcm by adjusting an amount of carbon black which is put into the coating liquid. An electric conductivity of the impurity extracted water due to the pressurization in the pure water is equal to 145 μS/cm. The carrier of 95 weight % and the toner A of 5 weight % are mixed, thereby forming a developer. With respect to the developer, a print density and a background fog in a range from the environment of a superlow temperature and a low humidity (0° C., 0% RH) to the environment of a superhigh temperature and a high humidity (40° C., 80% RH) are examined by using the F-6174 remodeled machine (made by Fujitsu Ltd.) of The FIGURE. By using the developer, consequently, a fog of the item (2) in the environment of a superhigh temperature and a high humidity (40° C., 80% RH) occurs.

Comparison Example 7

Magnetite (1) and the coating material β are used and a carrier is formed by using the universal stirrer in a manner similar to the embodiment 1. A resistance of the carrier is set to $1\times10^6$ Ωcm by adjusting an amount of carbon black which is put into the coating liquid. An electric conductivity of the impurity extracted water due to the pressurization in the pure water is equal to 75 μS/cm. The carrier of 95 weight % and the toner A of 5 weight % are mixed, thereby forming a developer. With respect to the developer, a print density and a background fog in a range from the superlow temperature and a low humidity (0° C., 0% RH) are examined by using the F-6174 remodeled machine (made by Fujitsu Ltd.) of The FIGURE. By using the developer, consequently, a fog of the item (1) in the environment of a superhigh temperature and a high humidity (40° C., 80% RH) occurs.

The results of the above embodiments and comparison examples are shown in Table 1.

TABLE 1

| | Magnetic powder | Coating material | Carrier (i) | Carrier $Na^+$ (ppm) | Carrier $SO_4^{2-}$ (ppm) | Toner | Print blur | (1) Back-ground fog on paper | (2) Back-ground fog on drum |
|---|---|---|---|---|---|---|---|---|---|
| Embodiment 1 | Mn-Zn ferrite (1) | α | 45 | 1.8 | 0.4 | A | ○ | ○ | ○ |
| Embodiment 2 | Mn-Zn ferrite (1) | α | 46 | 1.9 | 0.4 | A | ○ | ○ | ○ |
| Embodiment 3 | Mn-Zn ferrite (1) | α | 43 | 1.7 | 0.4 | A | ○ | ○ | ○ |
| Comparison example 1 | Mn-Zn ferrite (1) | α | 43 | 1.7 | 0.3 | A | x | ○ | ○ |
| Comparison example 2 | Mn-Zn ferrite (1) | α | 45 | 1.8 | 0.4 | A | ○ | ○ | x |
| Comparison example 3 | Mn-Zn ferrite (1) | α | 45 | 1.8 | 0.5 | B | ○ | ○ | Δ |
| Comparison example 4 | Mn-Zn ferrite (2) | α | 120 | 3.5 | 0.4 | A | ○ | ○ | x |
| Comparison example 5 | Mn-Zn ferrite (1) | β | 75 | 2.8 | 1.0 | A | ○ | x | ○ |
| Embodiment 4 | Magnetite (1) | α | 45 | 2.8 | 0.5 | A | ○ | ○ | ○ |
| Comparison example 6 | Magnetite (2) | α | 145 | 4.8 | 0.6 | A | ○ | ○ | x |
| Comparison example 7 | Magnetite (1) | β | 75 | 3.8 | 0.9 | A | ○ | x | ○ |

(i) Electric conductivity of the extracted water (μS/cm)

As will be obviously understood from the Table 1, the maximum value of the electric conductivities of the impurity extracted water due to the pressurization of the carrier in the embodiments 1 to 4 is equal to 47 μS/cm in the embodiment 2. However, so long as the electric conductivity doesn't exceed 60 μS/cm, the fogs of the items (1) and (2) lie within an allowable range. Therefore, it has been confirmed that it is sufficient to improve the purity of the carrier so that the electric conductivity is equal to or less than 60 μS/cm.

What is claimed is:

1. A printing material comprising:

a toner containing a carbon-containing dye; and a carrier, mixed with the toner, the carrier containing a Mn—Zn ferrite magnetic powder having a purity such that when a sample of the magnetic powder is tested by a testing process in which 8 g of a sample is pressurized in 80 ml of pure water to a pressure of 4 atm, is heated to 143° C. and is maintained at 100% relative humidity in the pressurized heated state for 24 hours, and then the water is extracted, the extracted water has an electric conductivity at 25° C. of no more than 60 μS/cm, the magnetic powder being coated with methyl methacrylate resin having a purity such that when a sample of the methyl methacrylate resin is tested by said testing process, the extracted water has an electric conductivity of no more than 20 μS/cm, the carrier having a purity such that when a sample of the carrier is tested by said testing process, the extracted water has an electric conductivity of no more than 60 μS/cm.

2. A printing material according to claim 1, wherein the methyl methacrylate resin contains carbon black and the amount of carbon black in the methyl methacrylate resin is selected so that the electrical resistance of the carrier is from $1\times10^4$ to $1\times10^8$ Ωcm.

3. A printing material according to claim 1, wherein the toner comprises carbon black.

4. A printing material according to claim 1, wherein the toner has an electrical resistance of at least $1\times10^{11}$ Ωcm.

* * * * *